US005987754A

United States Patent [19]

Hirabayashi et al.

[11] Patent Number: 5,987,754

[45] Date of Patent: Nov. 23, 1999

[54] ELECTRIC CABLE CUTTER

[75] Inventors: Shigeru Hirabayashi; Toyoji Makita, both of Matsumoto; Masashi Isobe, Kyoto, all of Japan

[73] Assignees: Izumi Products Company; Japan Storage Co., Ltd., both of Japan

[21] Appl. No.: 09/041,002

[22] Filed: Mar. 12, 1998

[30] Foreign Application Priority Data

Mar. 13, 1997 [JP] Japan ..... 9-058821
Mar. 13, 1997 [JP] Japan ..... 9-058822

[51] Int. Cl.[6] ..... B26B 15/00

[52] U.S. Cl. ..... 30/228; 30/249

[58] Field of Search ..... 30/228, 92, 180, 30/188, 182, 209, 210, 216, 247, 249, 250; 83/580, 600; 475/263; 173/178

[56] References Cited

U.S. PATENT DOCUMENTS

| | | | |
|---|---|---|---|
| 4,898,249 | 2/1990 | Ohmuri | 173/178 |
| 5,067,240 | 11/1991 | You | 30/249 |
| 5,642,566 | 7/1997 | Hirabayashi . | |
| 5,897,454 | 4/1999 | Cannalirto | 475/263 |

FOREIGN PATENT DOCUMENTS 5-146935 12/1994 Japan .

*Primary Examiner*—Douglas D. Watts
*Attorney, Agent, or Firm*—Thelen Reid & Priest

[57] ABSTRACT

An electric cable cutter is provided which can shorten the working time period, which allows the cutting work to be performed with a rotational torque corresponding to the kind of a work piece, and which has a clutch mechanism that, when a torque repulsion force of a predetermined level or higher is exerted, can cut off a power transmission mechanism.

In a configuration wherein the rotational torque of an electric motor is transmitted to a cutter unit via a planetary gear reduction mechanism, the torque is transmitted via a plurality of gears (a constrained-gear train) which are rotatably disposed on a stationary portion and function as means for transmitting the rotational torque from a driving gear disposed in the final stage of the planetary gear reduction mechanism to a rotary blade. In the planetary gear reduction mechanism, projections are disposed on a side face of an internal gear constituting the planetary gear reduction mechanism, and a clutch mechanism is disposed in which a ball urged by a spring is abutted against a position between the projections. The cutter unit is configured by a stationary blade, and the rotary blade in which a sector gear is formed on the outer periphery.

11 Claims, 7 Drawing Sheets

ELECTRIC CABLE CUTTER

BACKGROUND OF THE INVENTION

The invention relates to an electric cable cutter for cutting a wire such as an electric wire, and more particularly to a portable electric cable cutter in which a wire or the like is cut via a gear reduction (speed change) mechanism by means of an electric motor which is powered by a battery.

When a cable is cut or wires of various diameters are cut in an electric facility work, or when a steel bar is cut in an ironworks, a construction work, or the like, a cable cutter is used. Cable cutters of the prior art include a hydraulic cable cutter, and a manual tool which uses a toggle mechanism. The assignee of the present patent application proposed an electric cable cutter of the battery type which is shown in FIG. 8 (Japanese patent application No. HEI5-146935). Specifically, the electric cable cutter comprise: a case 61 which houses a planetary gear speed change mechanism; a battery cartridge 62 which is detachably mounted in the lower portion of a handle 61*a* of the case 61; a stationary blade 66 which is fixed to the case 61; and a rotary blade 67 which is rotatably attached to a bolt 65 at an end portion of the stationary blade 66 and which has a sector gear 67*b* in the outer side.

The electric cable cutter is used in the following manner. The worker grasps the handle 61*a* by one hand so as to set the rotary blade 67 free. A wire to be cut (hereinafter, such an object to be cut or worked is referred to as a work piece) is placed inside the stationary blade 66. The rotary blade 67 is rotated by hand so that an end portion of the gear 67*b* engages with a driving gear 63 of the final stage of the planetary gear reduction mechanism housed in the case 61. When a switch lever (not shown) is then pressed, the work piece is cut by a high rotational torque. The electric cable cutter is convenient to use because it can be operated by one hand and it does not require a force to be exerted by an arm.

The above-mentioned electric cable cutter is configured so that the driving gear 63 of the final stage of the planetary gear reduction mechanism housed in the case 61 meshes with the gear 67*b* of the rotary blade 67. Since the sector gear 67*b* is a large gear, the length L1 or the central angle 1 of the arc of the sector gear 67*b* of the rotary blade 67 which arc elongates from the start of the meshing state with the driving gear 63 to the end of the state are inevitably made large. Therefore, the time period of the cutting work tends to be prolonged. Although a large driving force is required at the initial period of the cutting work, a smaller driving force is required as the cutting work advances. In the cutter of the prior art, the same meshing state is maintained from the start of the cutting work to the end and hence a slightly unstable state is produced.

Furthermore, work pieces which are to be cut by an electric cable cutter include those of various kinds ranging from a thin wire member to a thick and hard piece. If the cutting work is performed with a rotational torque corresponding to the kind of the work piece, the work can be efficiently done. In the case where a work piece is so hard that it is hardly cut, there are fears that an excessive torque repulsion force is exerted and the electric motor is overheated, and that the battery is over-discharged and the life of the battery is shortened.

SUMMARY OF THE INVENTION

The invention has been conducted in order to solve the above-discussed problems. It is an object of the invention to provide an electric cable cutter in which the arc of the sector gear of the rotary blade 67 has a length as short as possible so that the working time period is shortened, and the driving gear and the gear of the rotary blade attain a suitable meshing state in accordance with the wire cutting conditions.

It is another object of the invention to provide an electric cable cutter which allows the cutting work to be performed with a rotational torque corresponding to the kind of a work piece, and which has a clutch mechanism that, when a torque repulsion force of a predetermined level or higher is exerted, can cut off a power transmission mechanism.

In other words, in order to solve the above-discussed problems, an object of the invention is to provide (1) an electric cable cutter having a configuration in which a rotational torque of an electric motor is transmitted via a planetary gear reduction mechanism to a rotary blade of a cutter unit consisting of a stationary blade which is disposed on a stationary portion of a case and the rotary blade, a gear being formed on an outer periphery of said rotary blade, characterized in that means for transmitting the rotational torque from a driving geardisposed in a final stage of the planetary gear reduction mechanism to the rotary blade is configured by the driving gear disposed in the final stage of the planetary gear reduction mechanism, and a constrained-gear train consisting of a plurality of gears which are rotatably disposed on the stationary portion of a case.

Another object of the invention is to provide (2) an electric cable cutter characterized in that the cutter comprises: an electric motor; a clutch mechanism configured by an internal gear which is driven by a driving gear of the electric motor and which has a flat portion and a projection on a side face, a ball which is abutted against the flat portion of the side face of the internal gear, and a spring which is disposed in a gear case and which is urged via the ball; an intermediate gear reduction mechanism consisting of a plurality of pinions which is driven via the internal gear, and a gear; a planetary gear reduction mechanism which transmits a rotational torque from the intermediate gear reduction mechanism; and a cutter unit which is driven by a driving gear of the planetary gear reduction mechanism, the cutter unit consisting of a rotary blade and a stationary blade.

A further object of the invention is to provide (3) an electric cable cutter characterized in that the cutter comprises: an electric motor; a clutch mechanism configured by an internal gear which is driven by a driving gear of the electric motor and which has a flat portion and a projection on a side face, a ball which is abutted against the flat portion of the side face of the internal gear, and a spring which is disposed in a gear case and which is urged via the ball; an intermediate gear reduction mechanism consisting of a plurality of pinions which are driven via the internal gear, and a gear; a planetary gear reduction mechanism which transmits a rotational torque from the intermediate gear reduction mechanism; a constrained-gear train which is driven by a driving gear of the planetary gear reduction mechanism; and a cutter unit consisting of a rotary blade which is driven by the constrained-gear train, and a stationary blade.

A still further object of the invention is to provide (4) an electric cable cutter characterized in that the clutch mechanism of the means (2) or (3) is a planetary gear reduction mechanism in which the driving gear fixed to a driving shaft of the electric motor is used as a sun gear, and which has a planet gear support plate which pivotally supports a planet gear which meshes with the sun gear and also with the internal gear.

A still further object of the invention is to provide (5) an electric cable cutter characterized in that an internal gear is disposed in the planetary gear reduction mechanism of the means (2), (3), or (4), external teeth which mesh with internal teeth disposed on a case, and a groove into which a projection is to be fitted are disposed on an outer peripheral face of the internal gear, the projection being disposed in an end portion of a slide arm which is slid outside the case and passing toward an interior through a window opened in the case, internal teeth which mesh with a planet gear and external teeth which are disposed on an outer periphery of a planet gear support plate which pivotally supports the planet gear are disposed on an inner peripheral face of the internal gear, and the external teeth are engaged with and disengaged from internal teeth disposed inside the case, by laterally sliding the slide arm.

A still further object of the invention is to provide (6) an electric cable cutter characterized in that a partial gear made of an elastic material of a synthetic resin is fixed to one or both ends of the sector gear of the rotary blade of the means (1), (2), (3), (4), or (5).

BRIEF DESCRIPTION OF THE DRAWINGS

FIG. 6 shows an operation in the case where a work piece is cut by the electric cable cutter of the invention.

FIG. 7 shows an operation in the case where a work piece is cut by an electric cable cutter of the prior art.

DETAILED DESCRIPTION OF THE PREFERRED EMBODIMENT

Hereinafter, a specific embodiment of the invention will be described with reference to the accompanying drawings.

Figure 1:
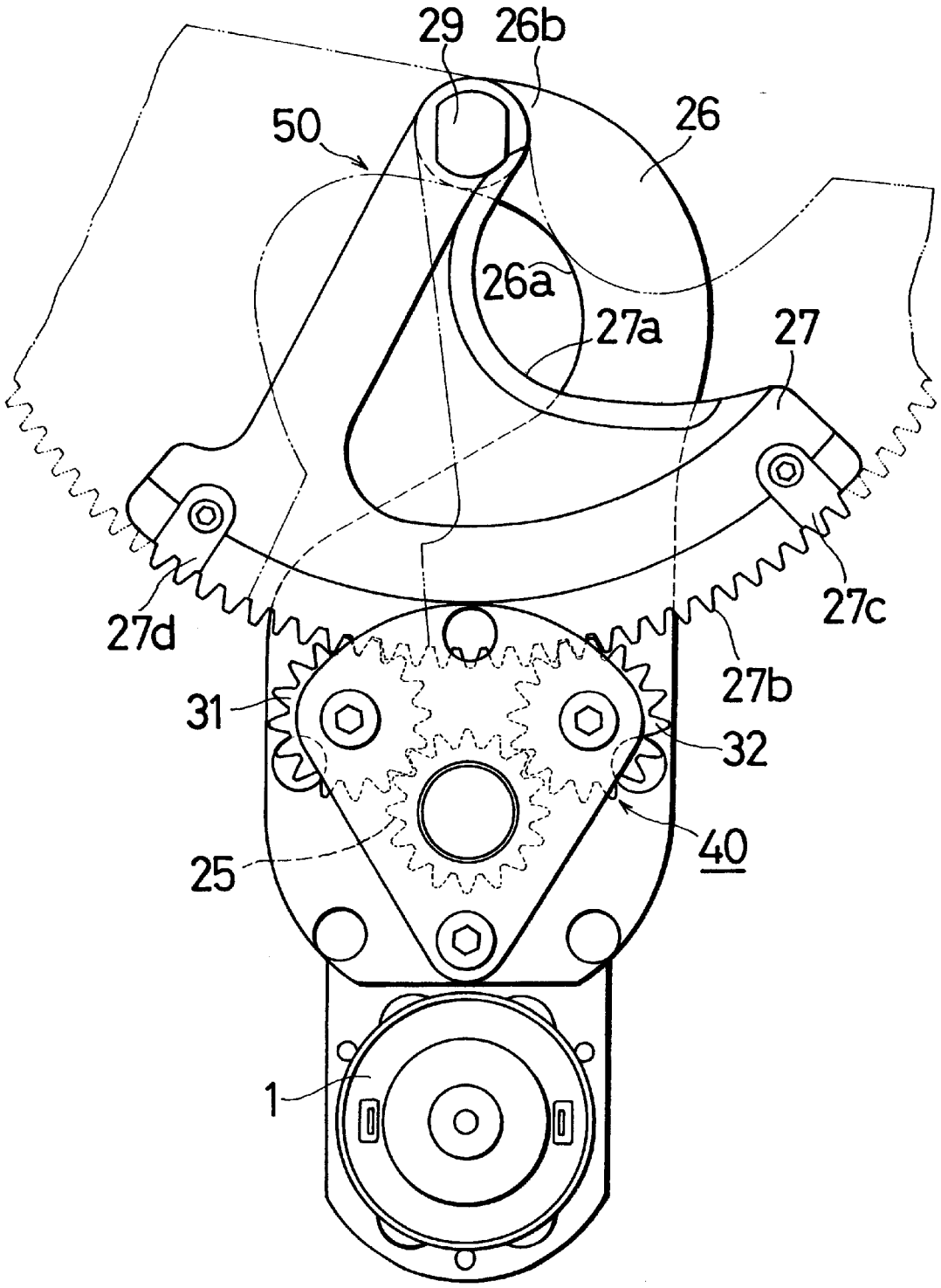
FIG. 1 is a front view of an upper portion of the electric cable cutter of the invention.
Figure 2:
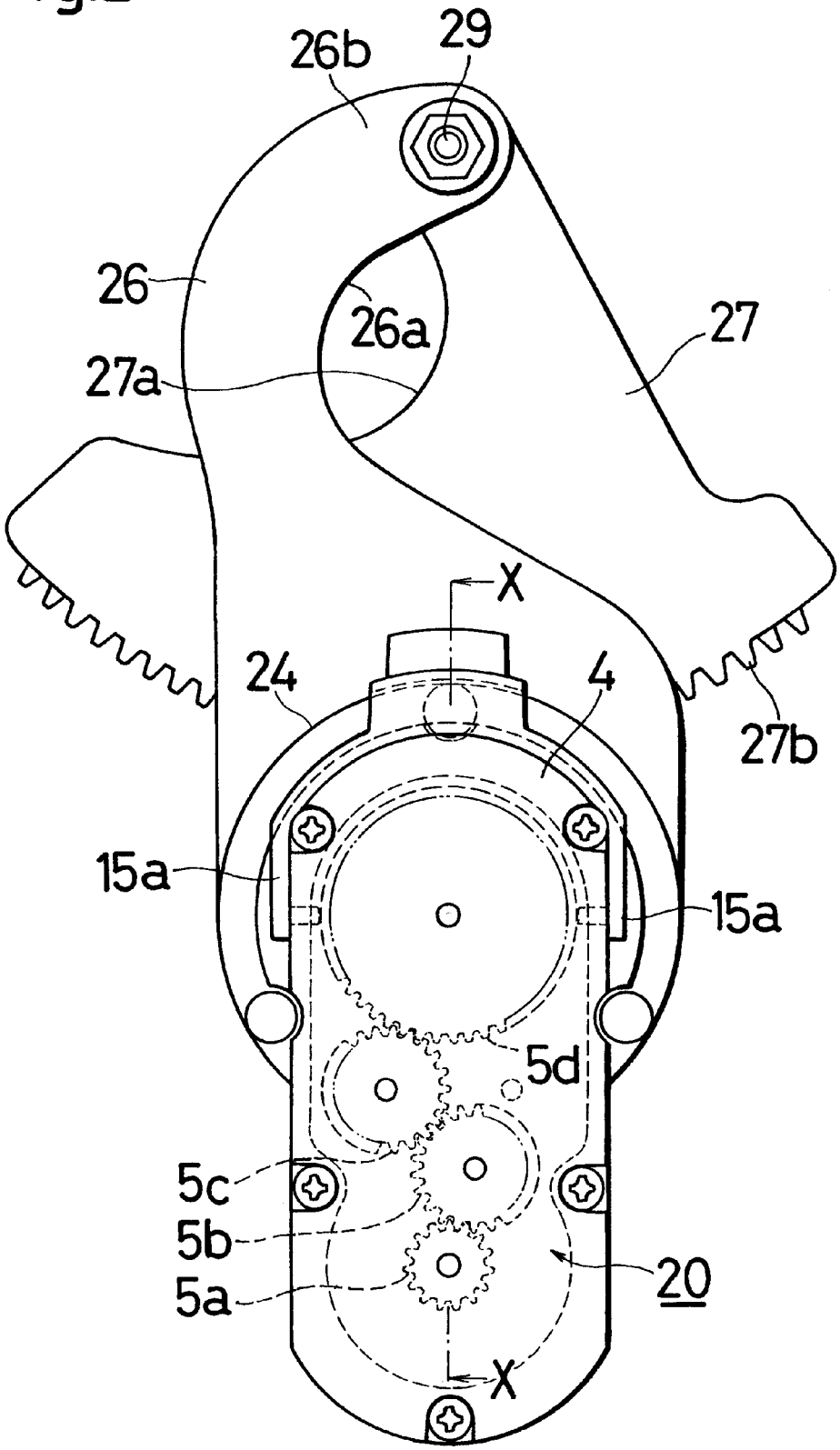
FIG. 2 is a rear view of the upper portion of the electric cable cutter of the invention.
Figure 3:
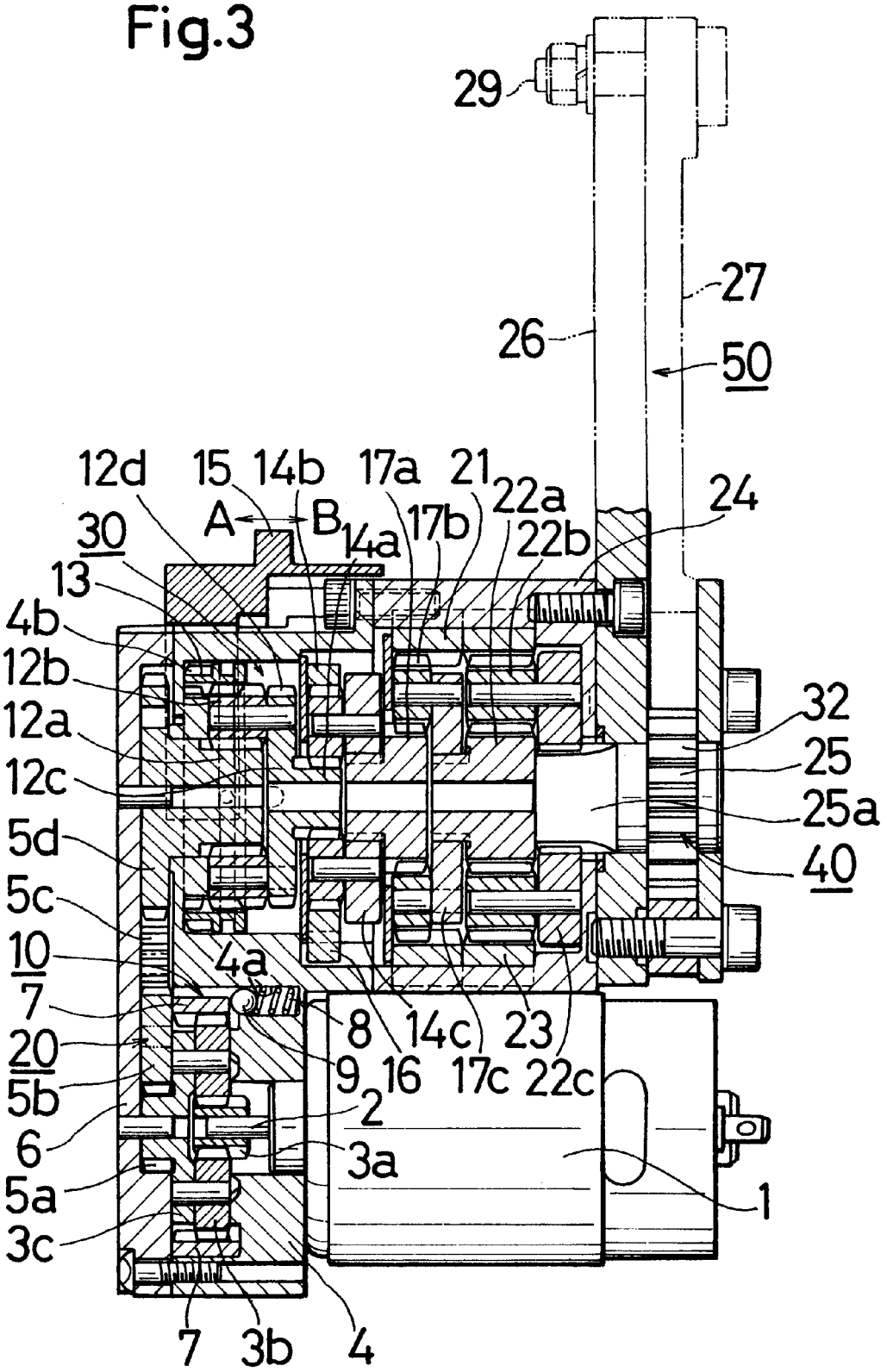
FIG. 3 is a section view taken along the line X—X of FIG. 2 and showing a power transmission mechanism of the electric cable cutter of the invention.
Figure 4:
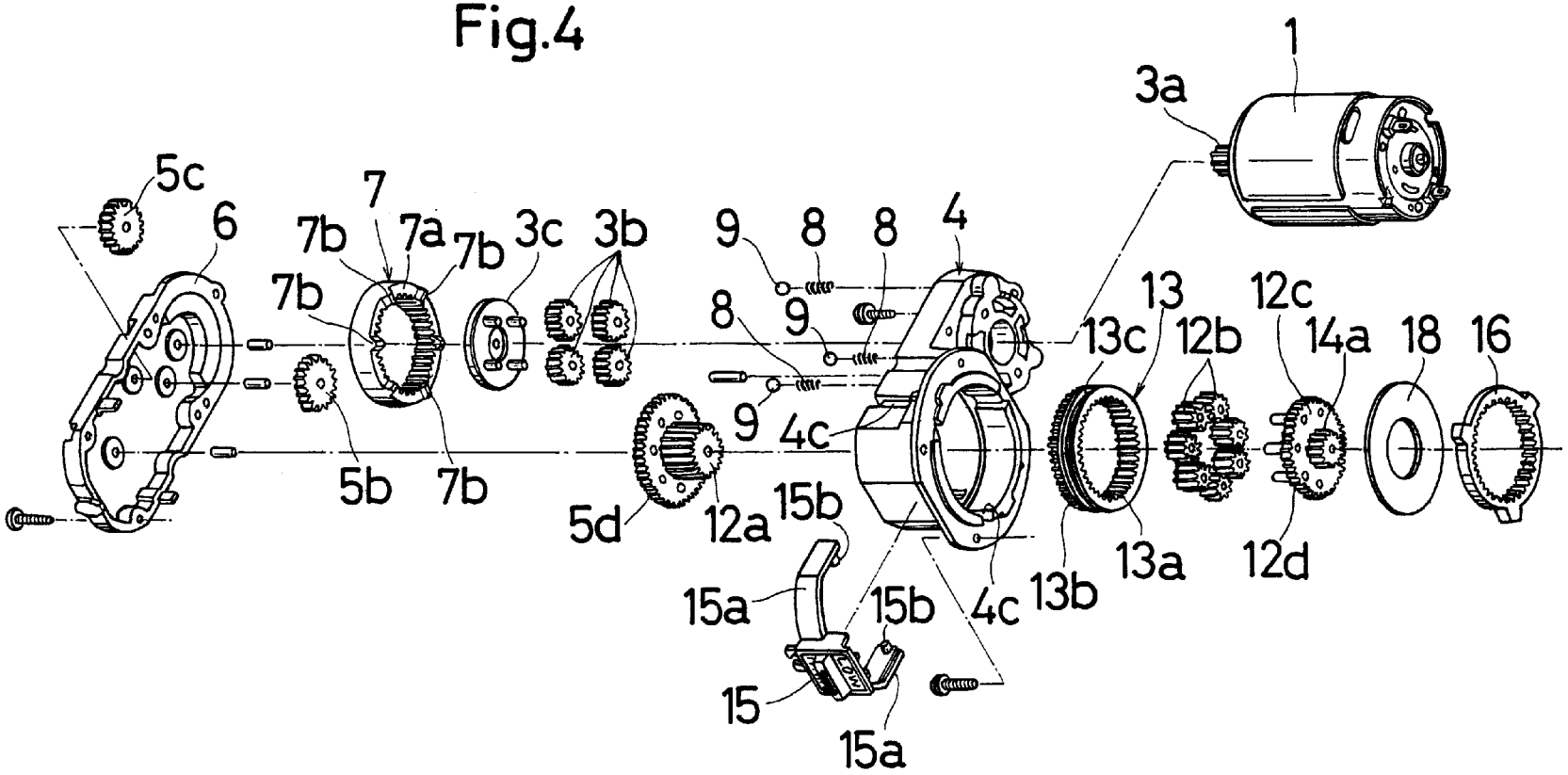
FIG. 4 is a perspective view showing a portion (front portion) of the power transmission mechanism of the electric cable cutter of the invention.
Figure 5:
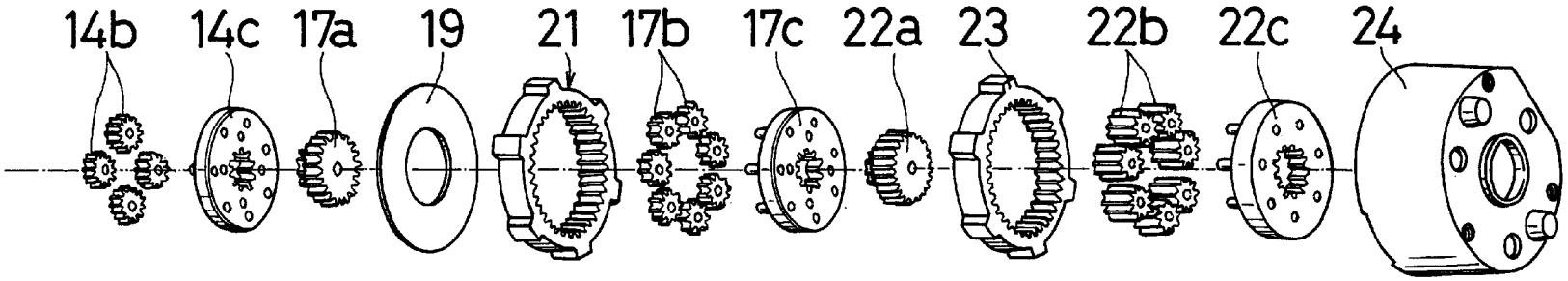
FIG. 5 is a perspective view showing a portion (rear portion) of the power transmission mechanism of the electric cable cutter of the invention.

FIG. 1 is a front view of the electric cable cutter of the invention, FIG. 2 is a rear view, FIG. 3 is a section view taken along the line X—X of FIG. 2 and showing a power transmission mechanism of the electric cable cutter of the invention, and FIGS. 4 and 5 are perspective views a power transmission mechanism of the electric cable cutter of the invention. The electric cable cutter comprises an electric motor 1, a clutch mechanism 10, an intermediate gear reduction mechanism 20, a planetary gear reduction (speed change) mechanism 30, a constrained-gear train 40, and a cutting unit 50. The electric motor 1 is powered by a battery (not shown).

The electric cable cutter is configured so that the rotation force of the electric motor 1 attached to a case 4 is transmitted from a driving gear 3*a* fixed to a driving shaft 2 of the electric motor 1 to a driving gear (pinion) 25 of the final stage via the intermediate gear reduction mechanism 20 and the planetary gear reduction mechanism 30, thereby driving a rotary blade 27 of the cutting unit 50 via the constrained-gear train 40.

In the following description, it is assumed that the driving gear 3*a* is a sun gear 3*a* of a planetary gear reduction mechanism of a first stage, and a sun gear of a second stage of the planetary gear reduction mechanism 30 which will be described later corresponds to a sun gear 12*a* formed on a gear 5*d* of a gear train of the intermediate gear reduction mechanism 20.

The sun gear 3*a* of the first stage meshes with planet gears 3*b* of the first stage and pivotally supported by a planet gear support plate 3*c* on which a pinion 5*a* constituting the intermediate gear reduction mechanism 20 is formed in the center portion of the opposite side. The planet gears 3*b* of the first stage mesh also with an internal gear 7 disposed in the case 4. The internal gear 7 constitutes the clutch mechanism 10 which, when an excessive torque repulsion force of a predetermined level or higher is exerted, establishes an idling condition, and is placed between the case 4 and a cover case 6.

The clutch mechanism 10 comprises: the internal gear 7; springs 8 which are respectively placed in holes 4*a* formed at predetermined intervals in the peripheral direction (in the embodiment, at intervals of 120 deg.) and at positions opposed to the internal gear 7 of the peripheral portion of the case 4; and balls 9 which are placed so that the springs 8 are urged by the side face 7*a* of the internal gear 7. Projections 7*b* are formed on the side face 7*a* of the internal gear 7 at predetermined intervals in the peripheral direction (in the embodiment, at intervals of 60 deg.) (see FIG. 4).

The pinion 5*a* transmits the rotation force to the gear 5*d* pivotally supported on the cover case 6, via pinions 5*b* and 5*c* pivotally supported on the cover case 6. The pinion 5*a*, the pinions 5*b* and 5*c*, and the gear 5*d* constitute the intermediate gear reduction mechanism 20. The sun gear 12*a* of the second stage of the planetary gear reduction mechanism 30 is formed in the center portion of the opposite side of the gear 5*d*. The sun gear 12*a* of the second stage meshes with planet gears 12*b* of the second stage pivotally supported on a planet gear support plate 12*c* on which a sun gear 14*a* of a third stage is formed in the center portion of the opposite side and external teeth 12*d* are formed. The planet gears 12*b* of the second stage mesh also with an internal gear 13 which is slidably disposed in the case 4. Furthermore, external teeth 12*d* which can mesh with internal teeth 13*a* of the internal gear 13 which will be described later are formed on the outer periphery of the planet gear support plate 12*c* of the second stage.

On the internal gear 13, formed are the internal teeth 13*a* which mesh with the planet gears 12*b* of the second stage or the external teeth 12*d* disposed on the planet gear support plate 12*c* of the second stage. Moreover, external teeth 13*b* which mesh with internal teeth 4*b* disposed on the case 4, and a groove 13*c* into which projections 15*b* are to be fitted are formed on the internal gear 13. The projections are disposed in both the end portions of an arcuate arm 15*a* which is formed integrally with a speed change lever 15. The rotational speed can be changed to be high or low by operating the change lever 15.

The projections 15*b* of the change lever 15 enter the interior through windows 4*c* which are disposed in both the sides of the case 4 (at an interval of 180 deg.), respectively (see FIG. 4).

The sun gear 14*a* of the third stage which is formed on the planet gear support plate 12*c* of the second stage meshes with planet gears 14*b* of the third stage pivotally supported on a planet gear support plate 14*c* of the third stage on which a sun gear 17*a* of a fourth stage of the planetary gear reduction mechanism is integrally formed (integrated by spline fitting) in the opposite side. The planet gears 14*b* of the third stage mesh also with an internal gear 16 of the third stage which is fixedly disposed in the case 4. A first washer 18 is placed between the internal gear 16 of the third stage and the planet gear support plate 12*c* of the second stage.

The sun gear 17*a* of the fourth stage which is formed on the planet gear support plate 14*c* of the third stage meshes with planet gears 17*b* of the fourth stage pivotally supported on a planet gear support plate 17*c* of the fourth stage on which a sun gear 22*a* of a fifth stage of the planetary gear reduction mechanism is integrally formed (integrated by spline fitting) in the opposite side. The planet gears 17*b* of the fourth stage mesh also with an internal gear 21 of the fourth stage which is fixedly disposed in the case 4. A second washer 19 is placed between the internal gear 21 of the fourth stage and the planet gear support plate 14*c* of the third stage. The sun gear 22*a* of the fifth stage meshes with planet gears 22*b* of the fifth stage pivotally supported on a planet gear support plate 22*c* of the fifth stage. The planet gears 22*b* of the fifth stage mesh also with an internal gear 23 of the fifth stage which is fixedly disposed in the case 4. Female splines are formed in the center portion of the planet gear support plate 22*c* of the fifth stage. Male splines formed on a shaft 25*a* of the driving gear 25 are fitted into the female splines, respectively.

The planet gears 17*b* of the fourth stage pivotally supported on the planet gear support plate 17*c* of the fourth stage, and the planet gears 22*b* of the fifth stage pivotally supported on the planet gear support plate 22*c* of the fifth stage have the same number of teeth as the internal gears 21 and 23 of the fourth and fifth stages. Therefore, these gears rotate at the same rotation number (in other words, the planetary gear reduction mechanisms of the fourth and fifth stages perform the same rotation and are not decelerated).

A stationary blade 26 on which an edge 26*a* is formed is disposed on a stationary portion of the case 24. An end portion of a rotary blade 27 is rotatably attached to a tip end portion 26*b* of the stationary blade 26 by a bolt 29. In the rotary blade, an edge 27*a* which cuts a work piece while pressingly holding it with respect to the stationary blade 26 is disposed, and a sector gear 27*b* is disposed on the outer periphery. Two constrained gears 31 and 32 are rotatably attached to the stationary blade 26. The driving gear 25 meshes with the constrained gears 31 and 32. In other words, the rotary blade 27 is driven by the driving gear 25 via the constrained gears 31 and 32.

Partial gears 27*c* and 27*d* made of an elastic material such as a synthetic resin are fixed to the end portions of the sector gear 27*b* of the rotary blade 27, respectively. Namely, the rotary blade 27 is driven in such a manner that the gear 27*c* of the elastic material is first engaged with the one constrained gear 31 and the meshing state is then established. This configuration is employed in order to absorb the shock which is produced when the sector gear 27*b* meshes with the one constrained gear 31, and also to smoothly attain the meshing state. Alternatively, only one of the partial gears 27*c* and 27*d* may be disposed in one of the sides of the sector gear 27*b*.

The rotation force transmission mechanism of the electric cable cutter of the invention is configured as described above. When a switch lever (not shown) disposed in the handle 61*a* (the handle 61*a* and the like have the same shape as those of the invention) is then pressed, the rotation force of the electric motor 1 is transmitted from the sun gear 3*a* of the first stage to the driving gear 25 via the planetary gear reduction mechanism of the first stage comprising the clutch mechanism 10, and the intermediate gear reduction mechanism 20 comprising the pinion 5*a* and the like, and further via the planetary gear reduction mechanism 30 of the second and subsequent stages. The driving gear 25 which undergoes the multistage reduction meshes with the two constrained gears 31 and 32 of the constrained-gear train 40 which are rotatably attached to the stationary blade 26. Furthermore, the constrained gears 31 and 32 mesh with the sector gear 27*b* formed on the outer periphery of the rotary blade 27 of the cutting unit 50, thereby rotating the rotary blade 27. As a result, the work piece such as a cable which is placed between the stationary blade 26 and the rotary blade 27 is cut by the rotation of the rotary blade 27.

Figure 6A:
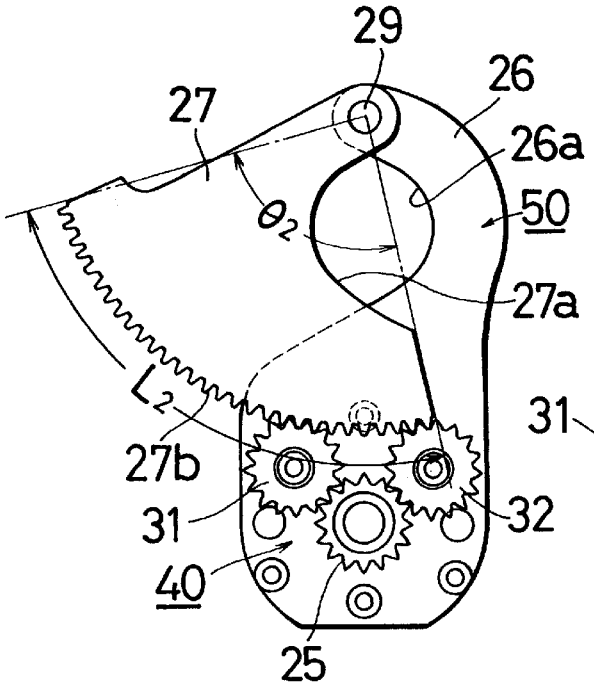
FIG. 6(A) shows a meshing state of a rotary blade in which the rotary blade meshes with two constrained gears in a cutting work.
Figure 6B:
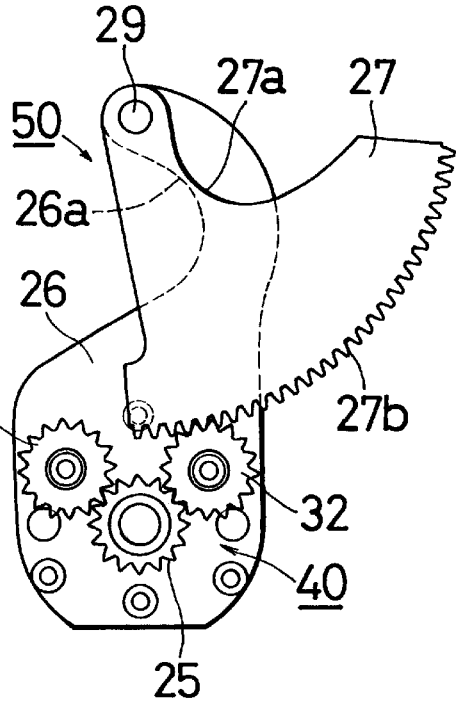
FIG. 6(B) shows a meshing state in which the rotary blade meshes with one of the constrained gears as a result of advancement of the cutting work.

FIGS. 6(A) and 6(B) show the meshing state between the stationary blade 26 and the rotary blade 27 which constitute the cutting unit 50. When the rotary blade 27 is to be rotated by the driving gear 25 via the two constrained gears 31 and 32 in order to cut a cable or the like, the driving gear 25 first meshes with one of the two constrained gears 31 and 32, i.e., the constrained gear 31. When the work of cutting the cable or the like is to be started, the sector gear 27*b* of the rotary blade 27 meshes with the two constrained gears 31 and 32 at the same time as shown in FIG. 6(A). When the cutting work advances, the sector gear 27*b* meshes with the one constrained gear 32 as shown in FIG. 6(B). Then, the meshing state is canceled.

Figure 7A:
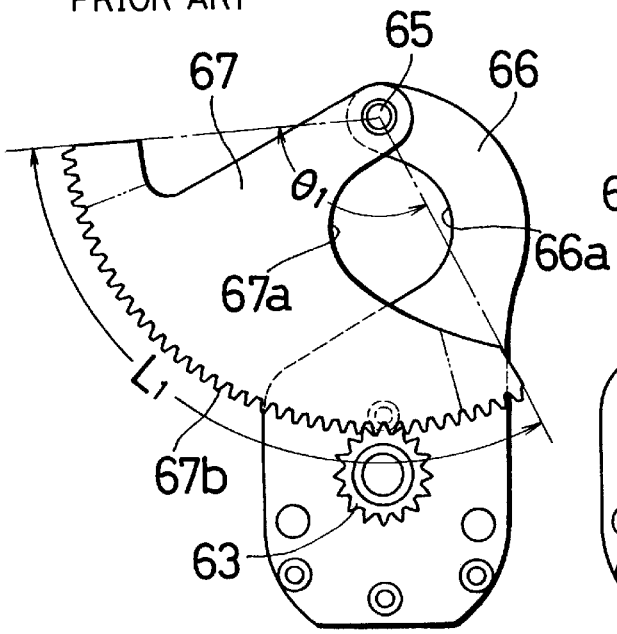
Fig.7(A) PRIOR ART
FIG. 7(A) shows a meshing state of a driving gear and a sector gear of a rotary blade in a cutting work.
Figure 7B:
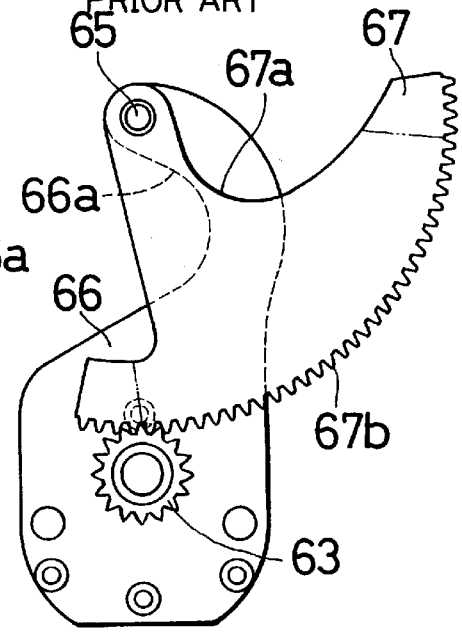
Fig.7(B) PRIOR ART
FIG. 7(B) shows the meshing state of the driving gear and the sector gear of the rotary blade in which the cutting work advances.
Figure 8:
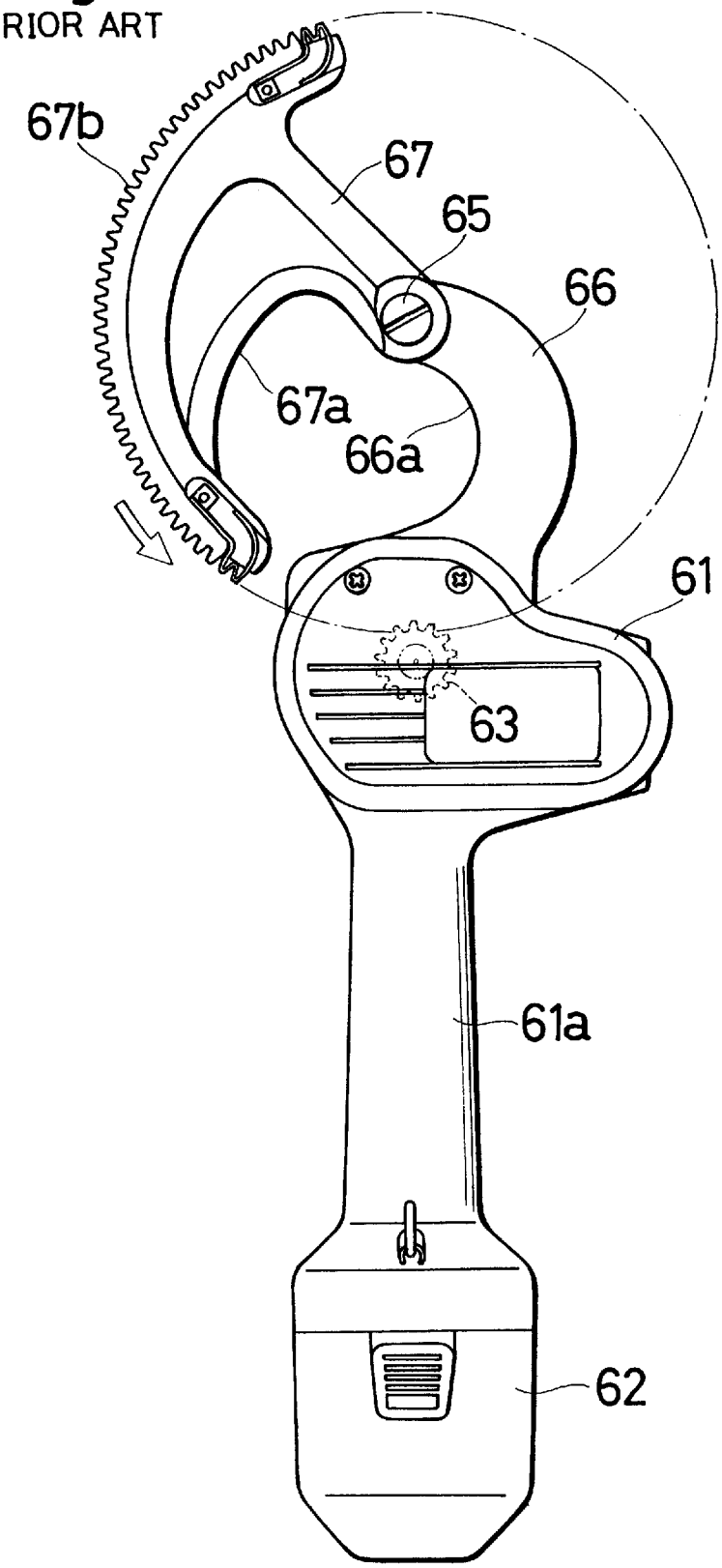
Fig.8 PRIOR ART
FIG. 8 is a rear view of the electric cable cutter of the prior art.

In the operations of the rotary blade 27 and the constrained gears 31 and 32 in the cable cutting work, when the work of cutting the cable is started, i.e., when the largest driving force is required, the sector gear meshes with the two constrained gears 31 and 32. When the rotary blade 27 is further rotated and a large driving force is not required for the cable cutting work, the sector gear meshes with the remaining one constrained gear 32. When the cable cutting work is then ended, the meshing state between the constrained gears 31 and 32 and the sector gear 27*b* is canceled. In this way, the sector gear 27*b* of the rotary blade 27 meshes with the two constrained gears 31 and 32 in accordance with the cable cutting conditions. The constrained gears 31 and 32 can formed so as to be thin and small. As apparent from the comparison with FIG. 7, the length L2 or the central angle 2 of the arc of the rotary blade 27 shown in FIG. 6 can be made shorter or smaller than the length L1 or the central angle 1 of the arc of the sector gear 67*b* of the rotary blade 67 of the prior art.

In the embodiment described above, the constrained-gear train 40 is used. Alternatively, this gear train may not be used, and the rotary blade 27 of the rotary blade may be driven by the driving gear 25 of the final stage of the planetary gear reduction mechanism 30.

A speed change mechanism is incorporated into the electric cable cutter of the invention so that either of a high-speed rotation and a low-speed rotation is selected in accordance with the kind of the work piece.

When the change lever 15 is slid in the direction of A shown in FIG. 3, the external teeth 13*b* of the internal gear 13 mesh with the internal teeth 4*b* disposed on the case 4 and hence the internal gear is fixed. Therefore, the planet gear support plate 12*c* of the second stage which pivotally supports the planet gears 12*b* of the second stage is decelerated or rotated at a low speed, with the result that the rotation force (high torque) is transmitted at a low speed to the driving gear 25.

When the change lever 15 is then slid in the direction of B, the meshing state between the external teeth 13*b* of the internal gear 13 and the internal teeth 4*b* disposed on the case 4 is canceled, and the internal teeth 13*a* of the gear meshes with the planet gears 12*b* of the second stage and the external teeth 12*d* of the planet gear support plate 12*c* of the second stage. Consequently, the sun gear 12*a* of the second stage, the planet gears 12*b* of the second stage, and the planet gear support plate 12*c* of the second stage are rotated integrally with each other. Therefore, the planet gear support plate 12*c* of the second stage which pivotally supports the planet gears 12*b* of the second stage is not decelerated or rotated at a high speed, with the result that the rotation force (low torque) is transmitted at a high speed to the driving gear 25. When a low-speed rotation or a high-speed rotation is performed as described above, it is possible to select a rotation number adequate for facilitating the work of cutting the work piece.

The rotational torque from the electric motor 1 is transmitted to the planet gears 3*b* of the first stage, the sun gear 12*a* of the second stage, and the like, in the state the internal gear 7 is urged by the combination of the springs 8 and the balls 9 which constitute the clutch mechanism 10. In this case, when the torque repulsion force in the transmission of the rotational torque is not higher than a predetermined level, the balls 9 cannot ride over the projections 7*b* formed on the side face 7*a* of the internal gear 7. When the work piece is hard and a torque repulsion force of a predetermined level or higher is exerted on the gear mechanism, for example, the balls 9 ride over the projections 7*b* disposed on the side face 7*a* of the internal gear 7. Therefore, the internal gear 7 starts to idle, and hence the transmission of the rotational torque is cut off. As a result, even when an excessive torque repulsion force is exerted, the clutch mechanism 10 can prevent the electric motor and the like from being overheated, and the battery from being over-discharged.

As described above in detail, according to the electric cable ctter of the invention, the length of the arc of the rotary blade can be shortened. Therefore, the time period of the cutting work can be shortened and the working efficiency can be improved in accordance with the shortened working time period. Since the weight as a whole can be reduced, the burden on the worker can be reduced. Furthermore, either of a low-speed rotation and a high-speed rotation is selected in accordance with the kind of the work piece. Moreover, even when an excessive torque repulsion force is exerted, the force can be relieved through the clutch mechanism. Consequently, the electric motor is not overheated and the life of the battery is not shortened as a result of over-discharge. Since also the speed changing mechanism is incorporated in the planetary gear reduction mechanism, the cutting work can be efficiently performed at a rotation number suitable for the work piece.

Since the partial gear portion made of an elastic material such as a synthetic resin is disposed at each of the end portions of the rotary blade, the shock which is produced when the rotary blade meshes with the gears of the constrained-gear train of the stationary blade can be absorbed and the meshing state can be smoothly attained.

What is claimed is:

1. An electric cable cutter, comprising:

a) a case;

b) an electric motor that provides rotational torque;

c) a cutter unit including:

1) a stationary blade that is disposed on a stationary portion of the case; and 2) a rotary blade having a periphery on which a sector gear is formed;

d) a planetary gear reduction mechanism for transmitting the electric motor's rotational torque to a driving gear; and e) a constrained-gear train, including a plurality of gears that are rotatably disposed on the stationary portion of the case, that transmits the rotational torque from the driving gear to the sector gear so as to rotate the rotary blade.

2. The electric cable cutter according to claim 1, wherein the planetary gear reduction mechanism includes:

1) at least one planet gear;

2) a planet gear support plate that supports the at least one planet gear, the planet gear support plate having an external periphery with external teeth;

3) an internal gear, the internal gear including:

i) external teeth that mesh with internal teeth that are disposed inside the case;

ii) internal teeth, disposed on an inner peripheral face of the internal gear, that mesh with the at least one planet gear or the external teeth of the planet gear support plate; and iii) an outer peripheral face with a groove into which a projection is adapted to be fit; and 4) a slide arm on which the projection is disposed, the projection passing into the groove through a window in the case, the slide arm being slidable from outside the case so as to engage and disengage the external teeth of the internal gear from the internal teeth disposed inside the case.

3. The electric cable cutter according to claim 1, further comprising:

a partial gear, made of an elastic material such as a synthetic resin, fixed to at least one end of the sector gear of the rotary blade.

4. An electric cable cutter comprising:

a) a case;

b) an electric motor having a first driving gear;

c) a clutch mechanism including:

1) an internal gear that is driven by the first driving gear, the internal gear having a side face with:

i) a flat portion; and ii) a projection;

2) at least one spring that is disposed in the case; and 3) at least one ball that is urged by a respective spring against the flat portion of the side face of the internal gear;

d) an intermediate gear reduction mechanism including:

1) a plurality of pinions that are driven via the internal gear; and 2) a gear;

e) a planetary gear reduction mechanism that transmits a rotational torque from the intermediate gear reduction mechanism to a second driving gear; and f) a cutter unit, driven by the second driving gear, and including:

1) a rotary blade; and
2) a stationary blade.

5. The electric cable cutter according to claim 4, wherein:

A) the first driving gear is a sun gear that is fixed to a drive shaft of the electric motor; and B) the electric cable cutter further comprises:
a) a planet gear that meshes both with the sun gear and with the internal gear; and
b) a planet gear support plate that supports the planet gear.

6. The electric cable cutter according to claim 4, wherein the planetary gear reduction mechanism includes:

1) at least one planet gear;

2) a planet gear support plate that supports the at least one planet gear, the planet gear support plate having an external periphery with external teeth;

3) an internal gear, the internal gear including:
i) external teeth that mesh with internal teeth that are disposed inside the case;
ii) internal teeth, disposed on an inner peripheral face of the internal gear, that mesh with the at least one planet gear or the external teeth of the planet gear support plate; and
iii) an outer peripheral face with a groove into which a projection is adapted to be fit; and 4) a slide arm on which the projection is disposed, the projection passing into the groove through a window in the case, the slide arm being slidable from outside the case so as to engage and disengage the external teeth of the internal gear from the internal teeth disposed inside the case.

7. An electric cable cutter according to claim 4, further comprising:

a partial gear, made of an elastic material such as a synthetic resin, fixed to at least one end of a sector gear of the rotary blade.

8. An electric cable cutter comprising:

a) an electric motor having a first driving gear;

b) a clutch mechanism including:
1) an internal gear that is driven by the first driving gear, the internal gear having a side face with:
i) a flat portion; and
ii) a projection;
2) at least one spring that is disposed in the case; and
3) at least one ball that is urged by a respective spring against the flat portion of the side face of the internal gear; and c) an intermediate gear reduction mechanism including:
1) a plurality of pinions that are driven via the internal gear; and
2) a gear;

d) a planetary gear reduction mechanism that transmits a rotational torque from the intermediate gear reduction mechanism to a second driving gear;

e) a constrained-gear train that is driven by the second driving gear; and f) a cutter unit including:
1) a rotary blade that is driven by the constrained-gear train; and
2) a stationary blade.

9. The electric cable cutter according to claim 8, wherein:

A) the first driving gear is a sun gear that is fixed to a drive shaft of the electric motor; and B) the electric cable cutter further comprises:
a) a planet gear that meshes both with the sun gear and with the internal gear; and
b) a planet gear support plate that supports the planet gear.

10. The electric cable cutter according to claim 8, wherein the planetary gear reduction mechanism includes:

1) at least one planet gear;

2) a planet gear support plate that supports the at least one planet gear, the planet gear support plate having an external periphery with external teeth;

3) an internal gear, the internal gear including:
i) external teeth that mesh with internal teeth that are disposed inside the case;
ii) internal teeth, disposed on an inner peripheral face of the internal gear, that mesh with the at least one planet gear or the external teeth of the planet gear support plate; and
iii) an outer peripheral face with a groove into which a projection is adapted to be fit; and 4) a slide arm on which the projection is disposed, the projection passing into the groove through a window in the case, the slide arm being slidable from outside the case so as to engage and disengage the external teeth of the internal gear from the internal teeth disposed inside the case.

11. An electric cable cutter according to claim 8, further comprising:

a partial gear, made of an elastic material such as a synthetic resin, fixed to at least one end of a sector gear of the rotary blade.

* * * * *